US007444707B2

(12) United States Patent
O'Reagan

(10) Patent No.: US 7,444,707 B2
(45) **Date of Patent: *Nov. 4, 2008**

(54) SHEAR REDUCING CHAIR CUSHION

(75) Inventor: James Richard O'Reagan, Greer, SC (US)

(73) Assignee: Span-America Medical Systems, Inc., Greenville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/961,969

(22) Filed: Oct. 8, 2004

(65) Prior Publication Data

US 2005/0076448 A1 Apr. 14, 2005

Related U.S. Application Data

(60) Provisional application No. 60/509,691, filed on Oct. 8, 2003.

(51) Int. Cl.
*A47C 27/14* (2006.01)

(52) U.S. Cl. ..... 5/736; 5/731

(58) Field of Classification Search ..... 5/736, 5/740, 730–731, 653

See application file for complete search history.

(56) References Cited

U.S. PATENT DOCUMENTS 5,568,660 A 10/1996 Raburn et al.
D393,071 S * 3/1998 Kennemore ..... D24/183
6,036,271 A 3/2000 Wilkinson et al.
6,256,822 B1 * 7/2001 Weston et al. ..... 5/732
6,381,784 B1 * 5/2002 Davis et al. ..... 5/636

* cited by examiner

*Primary Examiner*—Fredrick Conley
(74) *Attorney, Agent, or Firm*—Dority & Manning, P.A.

(57) ABSTRACT

A foam chair cushion having transverse support ribs is provided for reduction of shear stress between a person's skin and the surface of the chair cushion. The chair cushion may include transverse, lateral support ribs upon the support surface of the cushion. The support ribs have a predetermined cross-sectional geometry that is curvilinear, with a superior aspect generally disposed for receipt of a person and a inferior aspect opposite. The inferior aspect of the cross-section of the support ribs may undercut the portion of the support ribs vertically above it. Having such cross-sectional geometry, the support ribs are directionally oriented, either toward the one end or the other of the chair cushion. The chair cushion may include support ribs that are directionally oriented toward the foot of the chair in regions adapted for the person's upper torso, buttocks, and lower legs, and directionally oriented toward the head of the chair in a region adapted for the person's thighs. The chair cushion may also include longitudinal cuts in the support surface, perpendicular to the transverse support ribs, thereby defining independent support cells upon the support surface.

10 Claims, 9 Drawing Sheets

SHEAR REDUCING CHAIR CUSHION

CROSS-REFERENCE TO RELATED APPLICATIONS

This application claims benefit of U.S. Provisional Application No. 60/509,691, filed Oct. 8, 2003.

BACKGROUND OF THE INVENTION

This invention concerns a chair cushion with support surface features for reducing shear stress to the skin of a person received thereon.

In medical care, the prevention of decubitus ulcers to the skin of non-ambulatory persons remains a goal. Also known as "bed sores" and "pressure ulcers," decubitus ulcers may result in part from physiological causes such as decreased circulation, reduced skin integrity, impaired nutrition, and other bodily weaknesses. Certain areas of the body have been observed to have a relatively greater tendency to develop decubitus ulcers, including the spine, hips, buttocks, elbows, and heels. Conversely, certain portions of the body have been observed to have a relatively lesser tendency for the development of decubitus ulcers, such as the thigh area in which greater blood flow, the absence of bony prominences, and larger weight-bearing surfaces may be found.

In addition to physiological causes, external factors may contribute to the development of decubitus ulcers. Localized pressure to the skin is one such factor. Pressure to the skin occurs from support of the person's weight. Because different portions of the human body have different weights and have different surface areas for distribution of that weight upon a chair cushion, different pressure can be brought to bear at various locations along a person's body, with localized points of relatively great pressure. Of course, a generally planar surface, supporting the very non-planar human body, will result in even smaller areas of support, with concomitant greater increase in the pressure upon those areas.

Another external cause that may exacerbate the development of decubitus ulcers is moisture from perspiration, which makes the skin softer and more tender. As a person sits in a chair, for example, perspiration from skin in contact with the chair cushion surface may tend to accumulate rather than fully evaporate. By remaining in contact with the skin, the perspiration softens the skin and makes it more susceptible to breakdown, and thereby more susceptible to decubitus ulcers.

Still a third external exacerbation of the tendency of decubitus ulcer development is shear stress upon the skin. Shear stress occurs, in part, from the friction of rubbing the surface of the skin. For a person sitting in a chair, for example, shear occurs specifically between the person's skin and the chair cushions. That shear stress may result not only from movement of the person upon the surface of the chair, but also from gravity upon the person as the person's body is forced downward along the inclined slope of the back of the chair. However, the degree and extent of that shear stress is influenced by the surface features of the chair cushions.

To combat the development of decubitus ulcers and to promote the healing of existing decubitus ulcers, the medical practice has employed the use of foam chair cushions, foam overlays upon conventional chair cushions, and foam cushions for chairs, for use with persons at risk of such problems. While various foam products have been developed, no design has emerged that generally encompasses all of the desired characteristics as hereinafter presented in accordance with the present technology.

SUMMARY

The present invention includes generally a chair cushion of resilient material containing a plurality of directionally oriented support ribs transverse to the longitudinal length of the cushion. Such support ribs have a predetermined cross-sectional geometry that is curvilinear. Because the cross-sectional geometry is curvilinear, the support ribs contain no protuberance that would tend to increase shear stress to the skin of a person upon the cushion. Further, the centerline of the cross-section of each support rib is inclined at an acute angle relative to the foam beneath it, providing a directional orientation to each support rib that is transverse to the support rib and lengthwise along the cushion. According to this geometry, the cross-section of each support rib includes a superior aspect that is disposed generally for receipt of a person upon the cushion. Additionally, this geometry likewise includes an opposite inferior aspect to the geometry of each support rib. The superior aspect and the inferior aspect meet generally at the center line of the geometry of the cross-section of a support rib and together constitute the entirety of the cross-section of a support rib. The inferior aspect of the cross-sectional geometry may also undercut the superior aspect relative to the vertical dimension of the cushion. A support rib so configured may be biased to more readily compress or collapse toward the undercutment. As such, shear stress will tend to be lessened for movement by a person in the direction of the directional orientation of the support ribs.

A chair cushion including such directional support ribs may be configured to include different zones of such directional support ribs along its longitudinal length. Such different zones may be created by fabricating the cushion with directional support ribs at certain locations along the length of the cushion that are directionally oriented toward the foot of the cushion, and oppositely at other locations. The directional orientation of the support ribs for those locations expected to receive and support a person's head and upper torso may be directed toward the feet of the person received thereon, while the directional orientation of the support ribs adapted for support of a person's thighs may be directed toward the person's head. In such a configuration, shear forces upon the skin of a person upon a chair with such a cushion would be reduced for the head, upper torso, and ischial tuberosities, while at the same time additional support and resistance to sliding would be provided for that portion of the person's weight borne by the person's thighs at which the tendency for the development of decubitus ulcers is physiologically less. In addition, or alternatively, such different zones may be created by varying the respective geometries of the superior aspects and inferior aspects of the cross-sections of different support ribs at different locations along the longitudinal length of the cushion, thereby changing the dimensions of the channels between adjacent support ribs, so as to provide systematized reduction in shear forces for those areas of the person's body more susceptible to the development of decubitus ulcers.

The present invention may comprise a support surface for which the uppermost portions of the support ribs reside in a single plane—that is to say, the cushion may have a uniform thickness. Alternatively, the cushion may have different thicknesses at different locations, adapted to more optimally receive different portions of a person's body situated thereon and to thereby minimize shear stress to the person's body. In one embodiment, the portion of the support surface adapted for receipt of the head and upper torso may define a progressively increasing thickness from the head area to the back area, with the maximum of such increasing thickness achieved at the lumbar area; the portion adapted for receipt of the gluteal region may comprise a first decreasing thickness from the lumbar area and then a constant thickness for the hips area, which may lie at the juncture typically at which the seat of the chair meets the back of the chair; the portion adapted for receipt of the thighs of a person may define another progressively increasing thickness from the hip area to the knee area, with the maximum of such increasing thickness achieved at the knee areas; and the portion adapted for receipt of the lower legs and feet may comprise a second decreasing thickness from the knee area to the foot of the cushion. So configured, the chair cushion may further provide for better management and reduction of shear forces, especially considering the effect of gravitational forces upon a person reclined thereon.

The present invention may also include longitudinal cuts or slices upon the support surface, along the length of the chair cushion. Such longitudinal cuts, intersecting the support ribs, create cells upon the surface of the cushion. Such cells may provide for pressure dispersion and, in cooperation with the geometry of the support ribs, may result in further shear reduction. Such longitudinal cuts may be equally spaced apart, or may have differential spacing as may be advantageous in given situations.

Additional objects and advantages of the inventions will be set forth in part in the following description or may be obvious from the description and the included drawings.

BRIEF DESCRIPTION OF THE DRAWINGS

The aspects described above, as well as other apparent aspects, advantages, and objectives of the present invention are apparent from the detailed description below in combination with the drawings in which.

DETAILED DESCRIPTION

Figure 1:
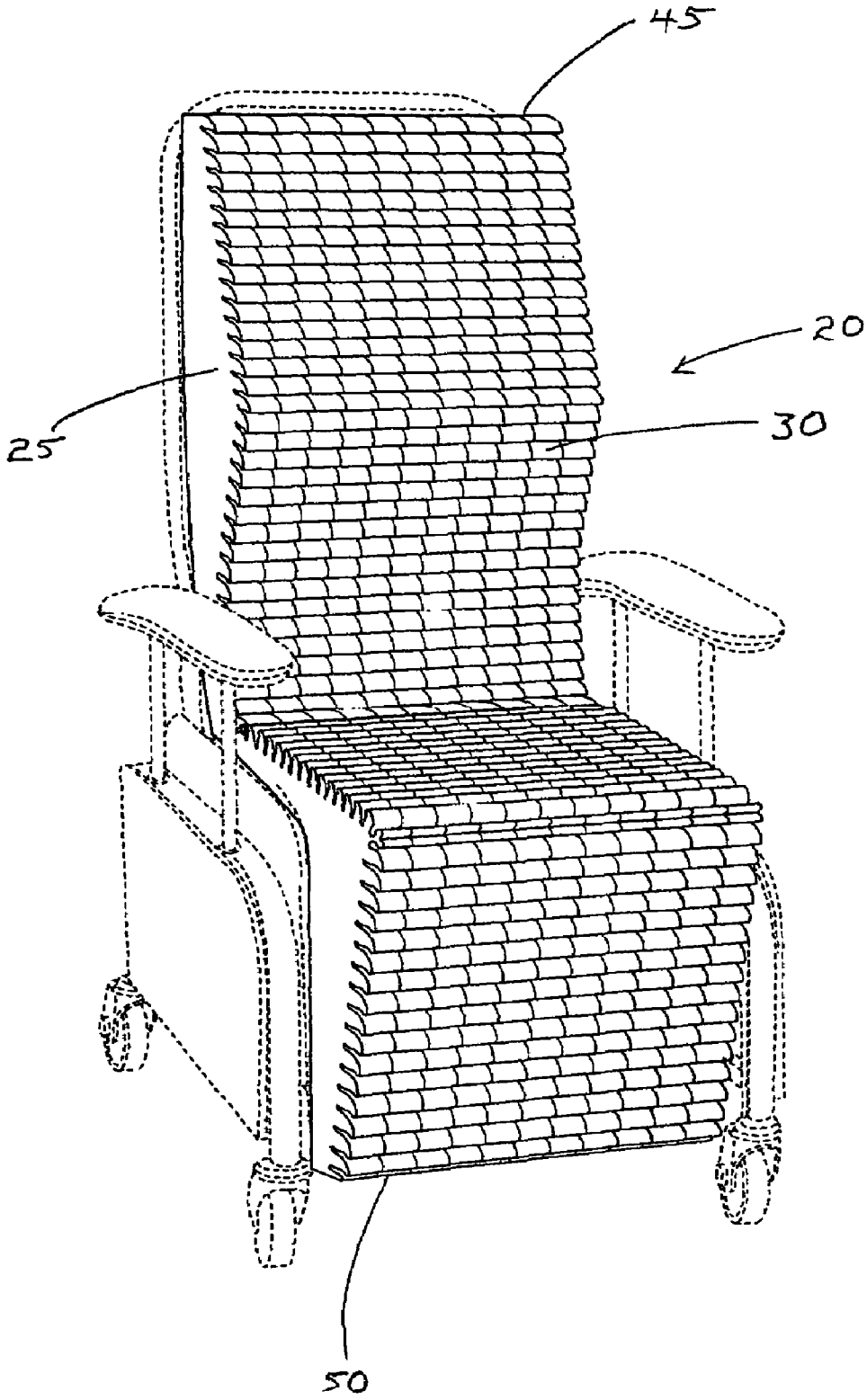
FIG. 1 is a perspective view of an exemplary chair cushion constructed according to the present invention.

Reference will now be made in detail to the presently preferred embodiments to the invention, one or more examples of which are illustrated in the drawings. Each example is provided by way of explanation of the invention, and not meant as a limitation of the invention. For example, features illustrated or described as part of one embodiment may be used on another embodiment to yield a still further embodiment. It is intended that the present application includes such modifications and variations as come within the scope and spirit of the invention. The same numerals are used to refer to the same features throughout the drawings and in the text that follows.

Referring to the figures, a chair cushion generally 20 includes a main body 25 comprised of a resilient material, for example polyurethane foam. The chair cushion 20 is generally rectangular. As described herein, a "chair cushion" may be understood to be of any predetermined thickness; in the appended drawings, a thickness is shown only for illustrative purposes.

The chair cushion 20 defines a upper support surface generally 30 for receipt of a person reclined thereon. The chair cushion 20 may be understood to have a longitudinal orientation from the head 45 of the chair cushion 20 to the foot 50. The chair cushion 20 may also be understood to have a lateral orientation from side to side.

Figure 2:
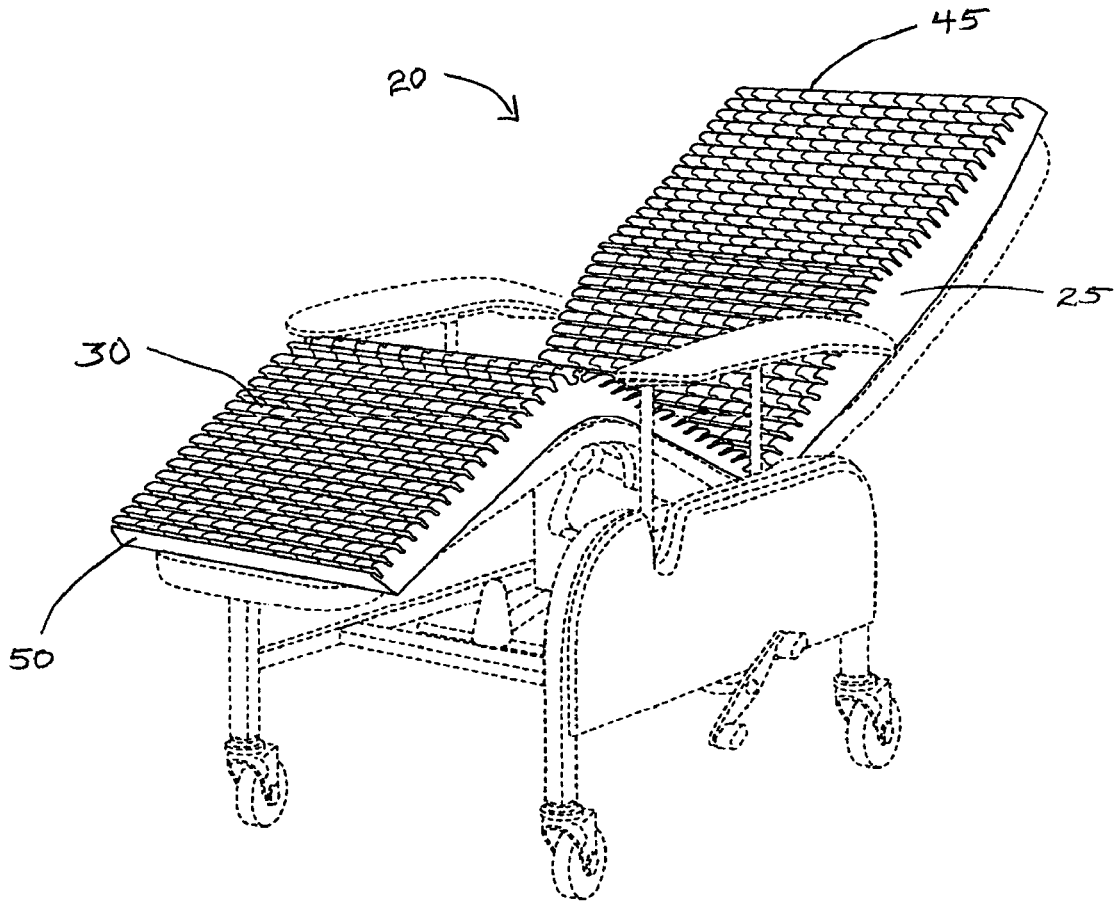
FIG. 2 is a perspective view of an exemplary chair cushion constructed according to the present invention, showing the chair reclined.

The upper support surface 30 of the chair cushion 20 includes a plurality of directional support ribs 65. The directional support ribs 65 extend laterally. The directional support ribs 65 may be disposed along the entire longitudinal length of the chair cushion 20, or instead may be disposed only in preselected areas along such length (not shown). As shown in FIG. 1, the chair cushion 20 may be used upon a chair that does not recline. Alternatively, and as illustrated in FIG. 2, the chair cushion 20 may be used with a chair capable of reclining.

Figure 4:
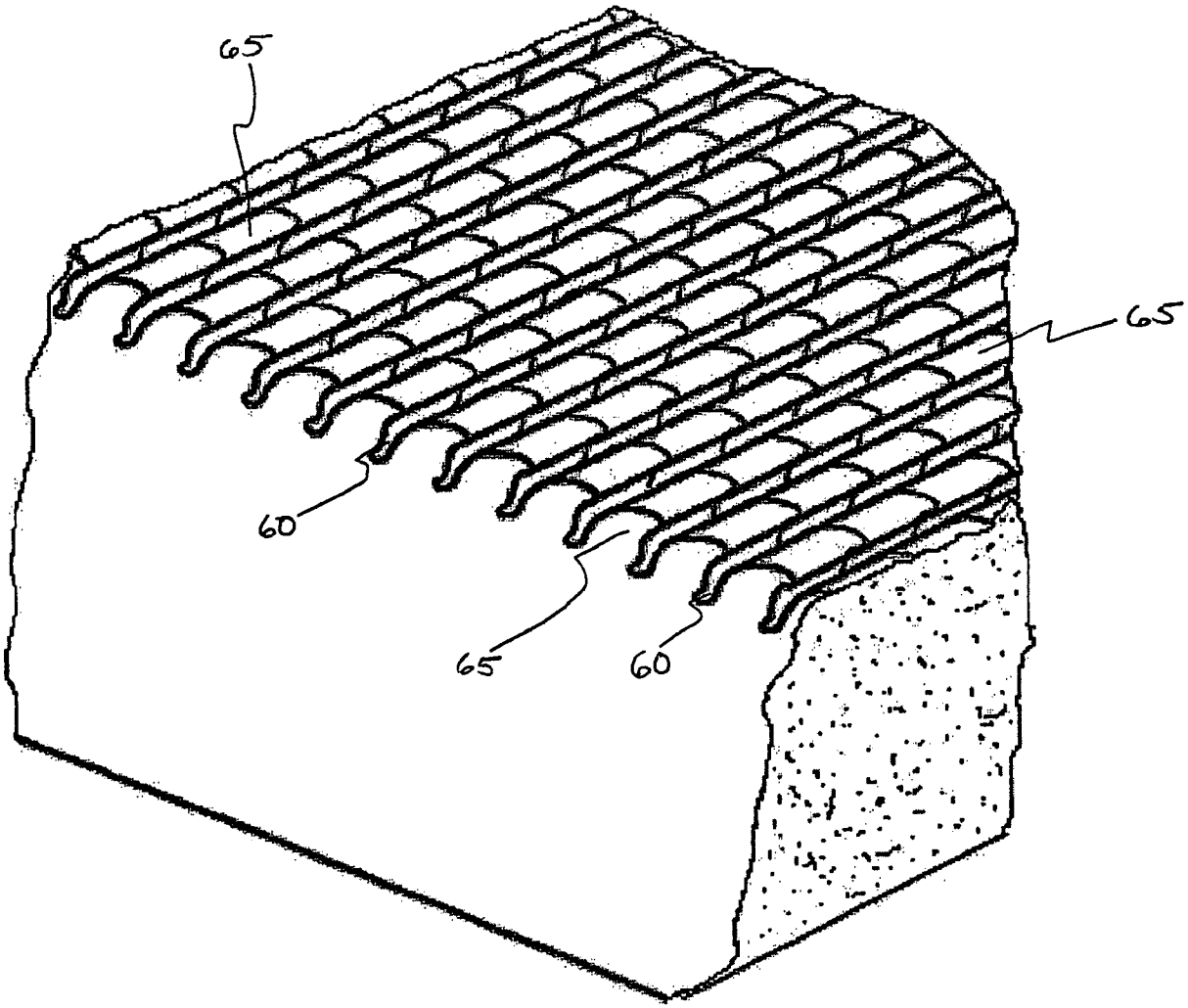
FIG. 4 is a first enlarged partial perspective view of a chair cushion according to the present invention.
Figure 5:
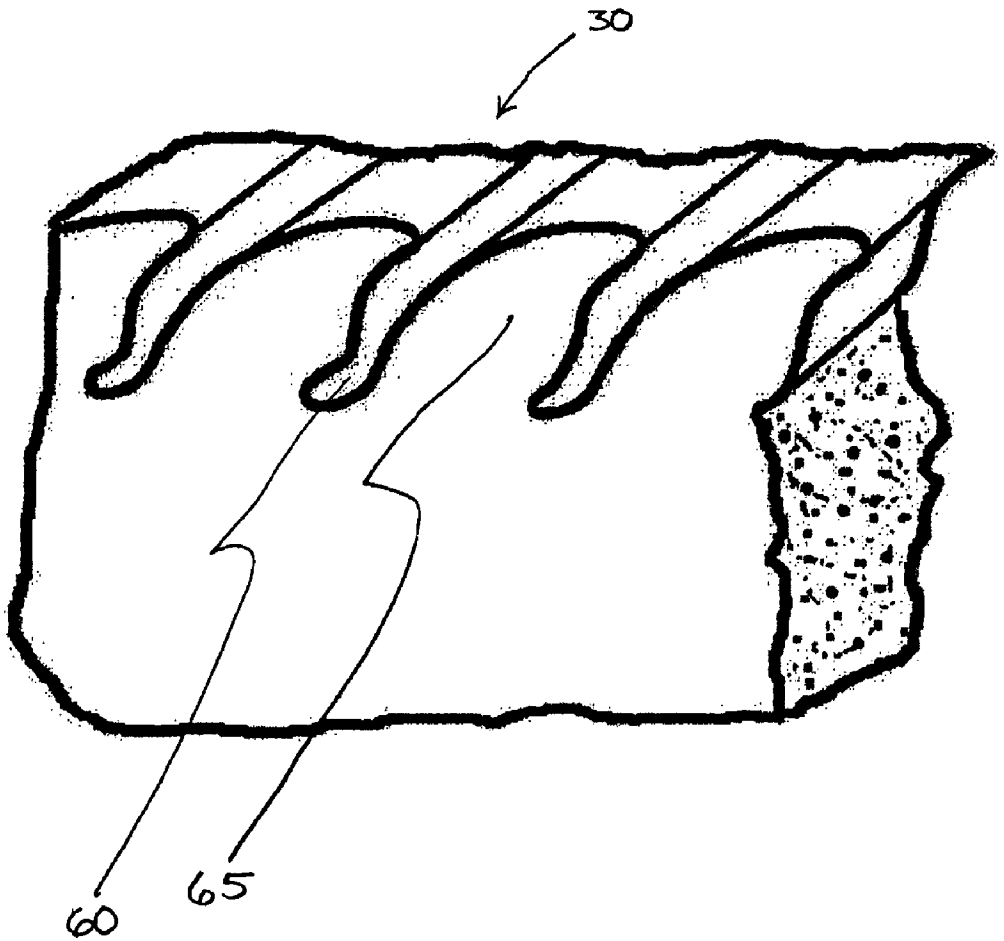
FIG. 5 is a second enlarged partial perspective view of a section of a chair cushion according to the present invention.

As illustrated in FIG. 4, the directional support ribs 65 may be formed by selective removal of the resilient material so as to create channels 60 in the remaining material. Selective removal of such resilient material may be accomplished by slicing, CNC machining, milling, and the like.

Figure 6A:
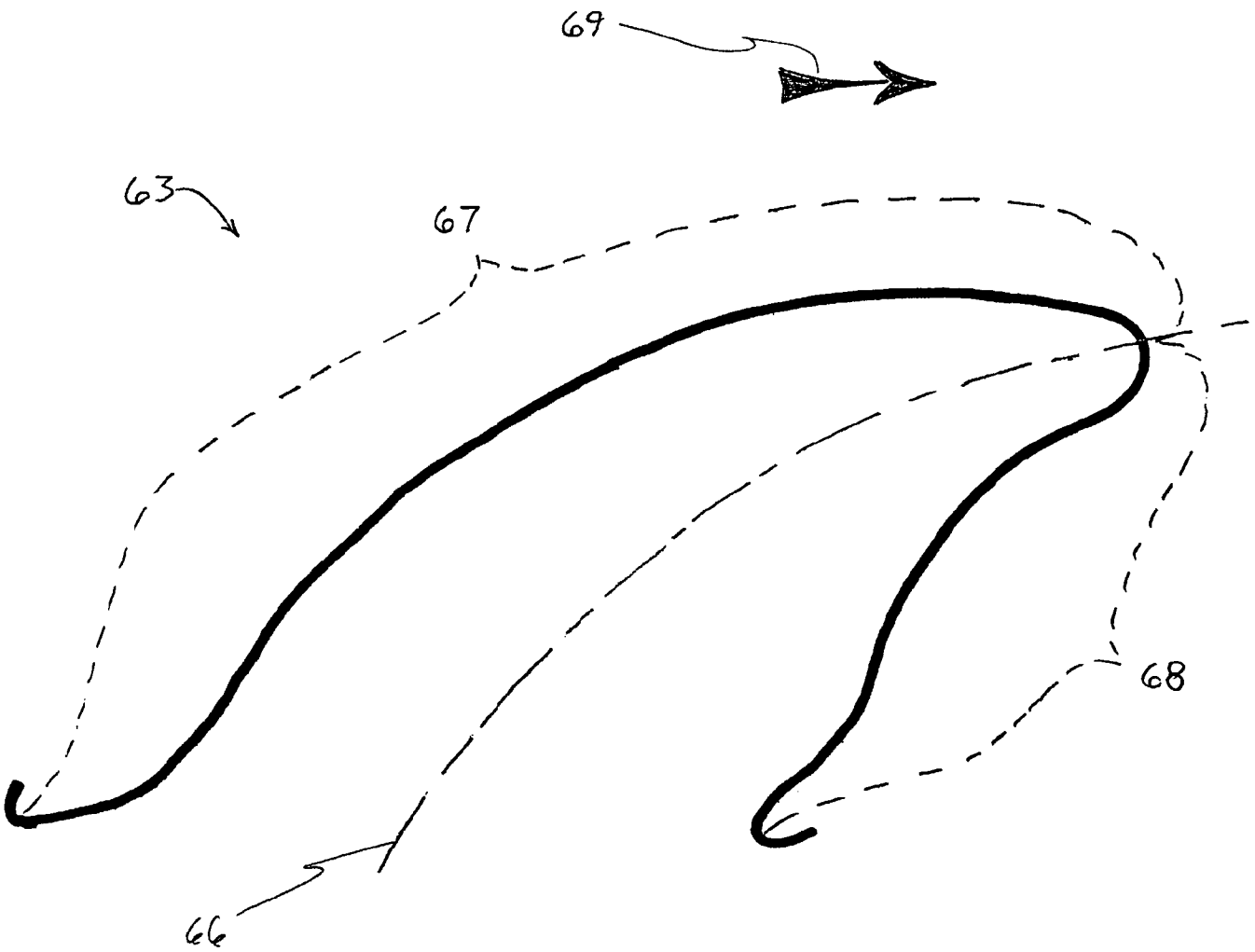
FIG. 6A is a sketch of a first exemplary cross-section of a support rib according to the present invention.
Figure 6B:
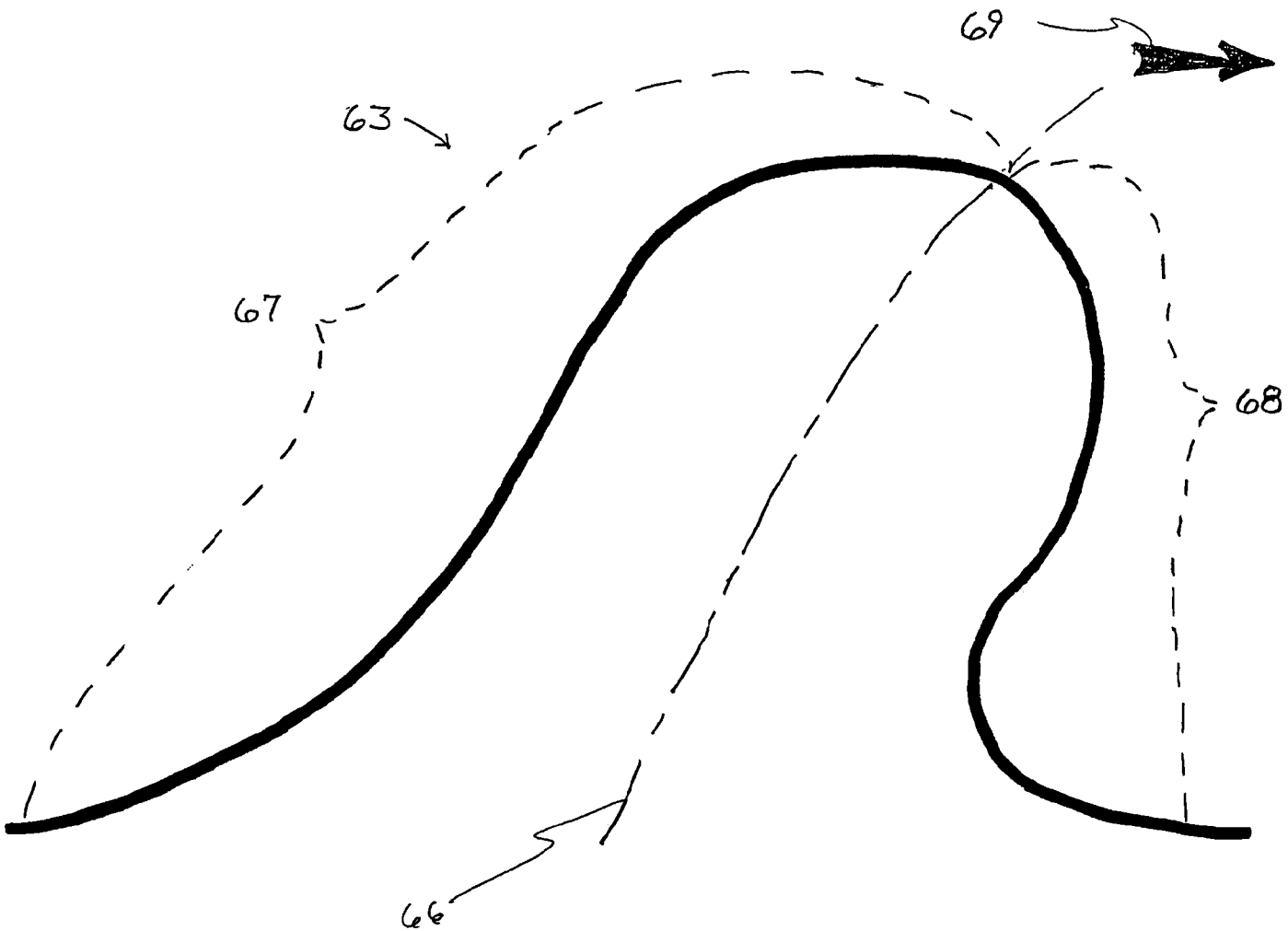
FIG. 6B is a sketch of a second exemplary cross-section of a support rib according to the present invention.
Figure 6C:
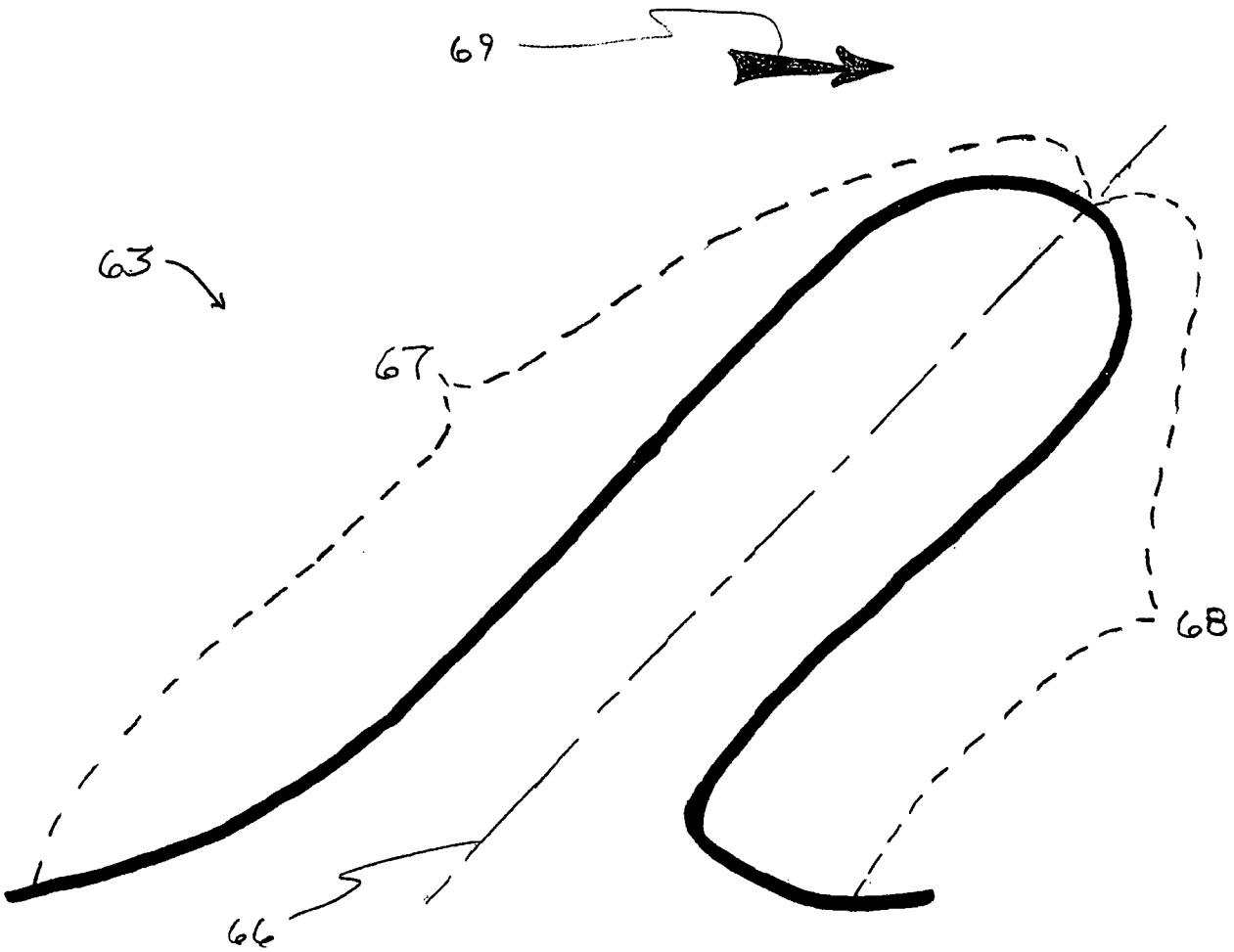
FIG. 6C is a sketch of a third exemplary cross-section of a support rib according to the present invention.

The directional support ribs 65 are configured to a predetermined cross-sectional geometry 63. Specifically, the directional support ribs 65 define a cross-sectional geometry 63 that may be curvilinear—formed, bounded, or characterized by curved lines. With reference to FIGS. 6A-6C, the curvilinear cross-section geometry 63 of the directional support ribs 65 may be understood to provide a superior aspect 67 and an inferior aspect 68. FIGS. 6A-6C show two dashed lines for illustration purposes only, to demonstrate the location of the superior aspect 67 and the inferior aspect 68, along with the center line 66 of the directional support rib 65. As will be observed from FIGS. 6A-6C, the superior aspect 67 of the directional support rib 65 is defined to constitute that portion of the exposed surface of the directional support rib 65 that may receive of a portion of the body of a user of the chair cushion 20. By comparison, the inferior aspect 68 of the directional support rib 65 may be understood to constitute that portion of the exposed surface of the directional support rib 65 that is unavailable or not disposed for receipt of any portion of the body of a person thereon. The superior aspect 67 and the inferior aspect 68 meet generally at the center line 66 of the directional support rib 65. It may be further understood that the center line 66 of directional support ribs 65 will lie at an acute angle to the horizontal plane, and may be thereby defined to have a directional orientation 69. Directional orientation 69 is perpendicular to the axis of the body of directional support rib 65 and parallel to the longitudinal orientation of the chair cushion 20.

The dimensions of the channels 60 may be varied. The dimensions of the channels 60 may be varied between different channels upon the chair cushion 20, for advantageous reasons, or may be uniform for each channel upon a given chair cushion 20.

The dimensions and cross-sectional configuration of the directional support rib 65 likewise may be varied. As shown in FIG. 6A, the length of the superior aspect 67 may greatly exceed the length of the inferior aspect 68. Alternatively, as shown in FIG. 6B, the length of the superior aspect 67 may only slightly exceed the length of the inferior aspect 68, but nevertheless provide a directional orientation 69 to the directional support rib 65. Moreover, the distance between adjacent channels 60 on either side of the directional support rib 65 may be varied, as illustrated by comparison between FIG. 6A and FIG. 6C. In FIG. 6A, the distance between adjacent channels 60 on either side of the directional support rib 65 may be relatively large, or as shown in FIG. 6C may be relatively small.

As will be appreciated from review of the Figures, the channel 60 may undercut a side of the directional support rib 65, such that a portion of the channel 60 lies vertically beneath a portion of the directional support rib 65. So configured, the directional support rib 65, made of a resilient material, will tend to be less resistant of movement of a person thereon in the direction of the directional orientation 69, and less receptive to movement by a person disposed thereon opposite of the directional orientation 69, in that the directional support rib 65 has less resilient material on its side favoring the directional orientation 69 and has more resilient material on the side against the directional orientation 69.

Chair cushion 20 may include along the entirety of its upper support surface 30 the directional support ribs 65. Alternatively, the directional support ribs 65 may be located only upon a portion of the upper support surface 30 (not shown).

Figure 3:
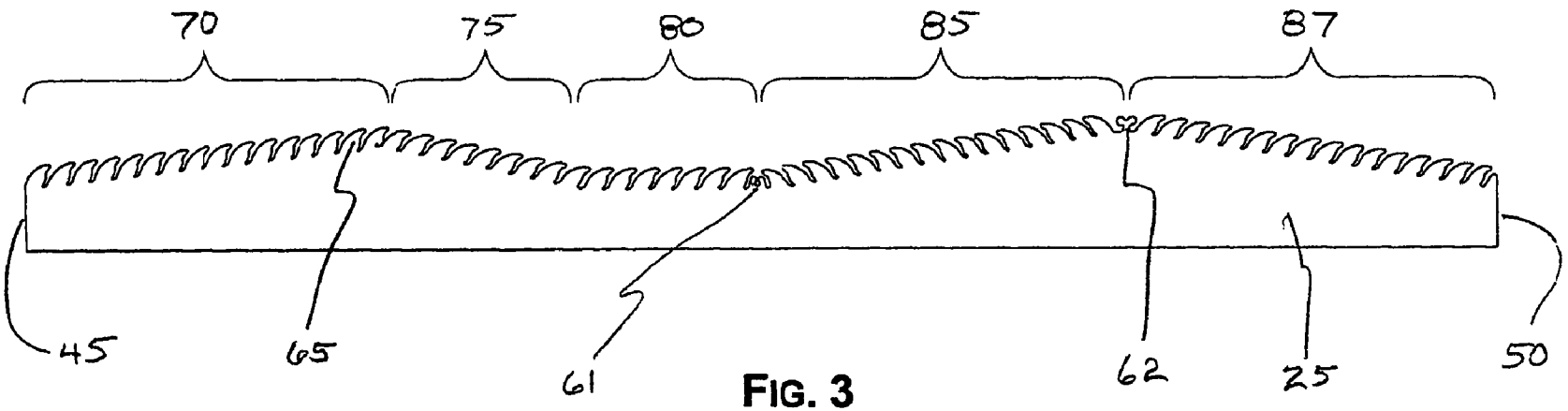
FIG. 3 is a side view of a chair cushion constructed according to the present invention.

The directional support ribs 65 may have a given directional orientation 69 in certain areas of the upper support surface 30 and an opposite directional orientation 69 in other areas upon upper support surface 30. Consider FIG. 3. As shown therein, the directional orientation 69 of the directional support ribs 65 in the area of the upper support surface 30 adapted for receipt of the upper torso of a person may have a directional orientation 69 toward the foot 50 of the chair cushion 20, while the directional orientation 69 of the directional support ribs 65 located upon the upper support surface 30 adapted for receipt of the thigh region of a person disposed thereon may have a directional orientation 69 toward the head 45 of the chair cushion 20. In such configuration, a person reclined upon the chair cushion 20 would suffer less shear stress in the upper torso and gluteal regions, notwithstanding gravitational forces against the body downward along the inclined upper support surface 30, because of the directional orientation of the support ribs toward the foot 50 of the chair. Nevertheless, in such an orientation, sliding by the person down toward the foot 50 of the chair would be resisted by the directional orientation 69 of the directional support rib 65 toward the head 45 of the chair in the thigh region of the body, at which the tendency to develop decubitus ulcers may be less. In FIG. 3, first channel artifact 61 and second channel artifact 62 are shown to remain on the chair cushion 20 as a result of transitions from directional orientation 69 in a given direction to directional orientation 69 in the opposite direction.

The chair cushion 20 may have all of its directional support ribs residing on a single plane (not shown). Alternatively, the upper support surface 30 may comprise a plurality of separate planes. For example, as illustrated in FIG. 3, the chair cushion 20 may include a first plane 70 disposed toward the head 45 of the chair cushion 20, adapted for receipt of the upper torso of a person reclined thereon. The chair cushion 20 may also include a second plane 75 intersecting with the first plane 70, the two planes 70 and 75 intersecting to create a lumbar support for a person reclined upon the chair cushion 20. Still further, the chair cushion 20 may include a third plane 80, intersecting with the second plane 75, the second and third planes 75 and 80, respectively, disposed for receipt of the gluteal region of a person reclined thereon. The chair cushion 20 may include a fourth plane 85, intersecting with the third plane 80, adapted for receipt of the thigh region of a person reclined thereon. Finally, the chair cushion 20 may include a fifth plane 87, intersecting with the fourth plane 85, adapted for receipt of the lower legs and feet of a person reclined thereon. Configured with such plurality of planes, the chair cushion 20 may be readily adapted for more complete contact along the length of the body of a person reclined thereon with as much of the upper support surface 30 of the chair cushion 20 as possible. Consequently, localized pressure between the person's skin and the chair cushion is more readily dispersed and lessened. Furthermore, shear stress between any given portion of the body of a person reclined thereon and the upper support surface 30 of the chair cushion 20 is thereby lessened.

Figure 7:
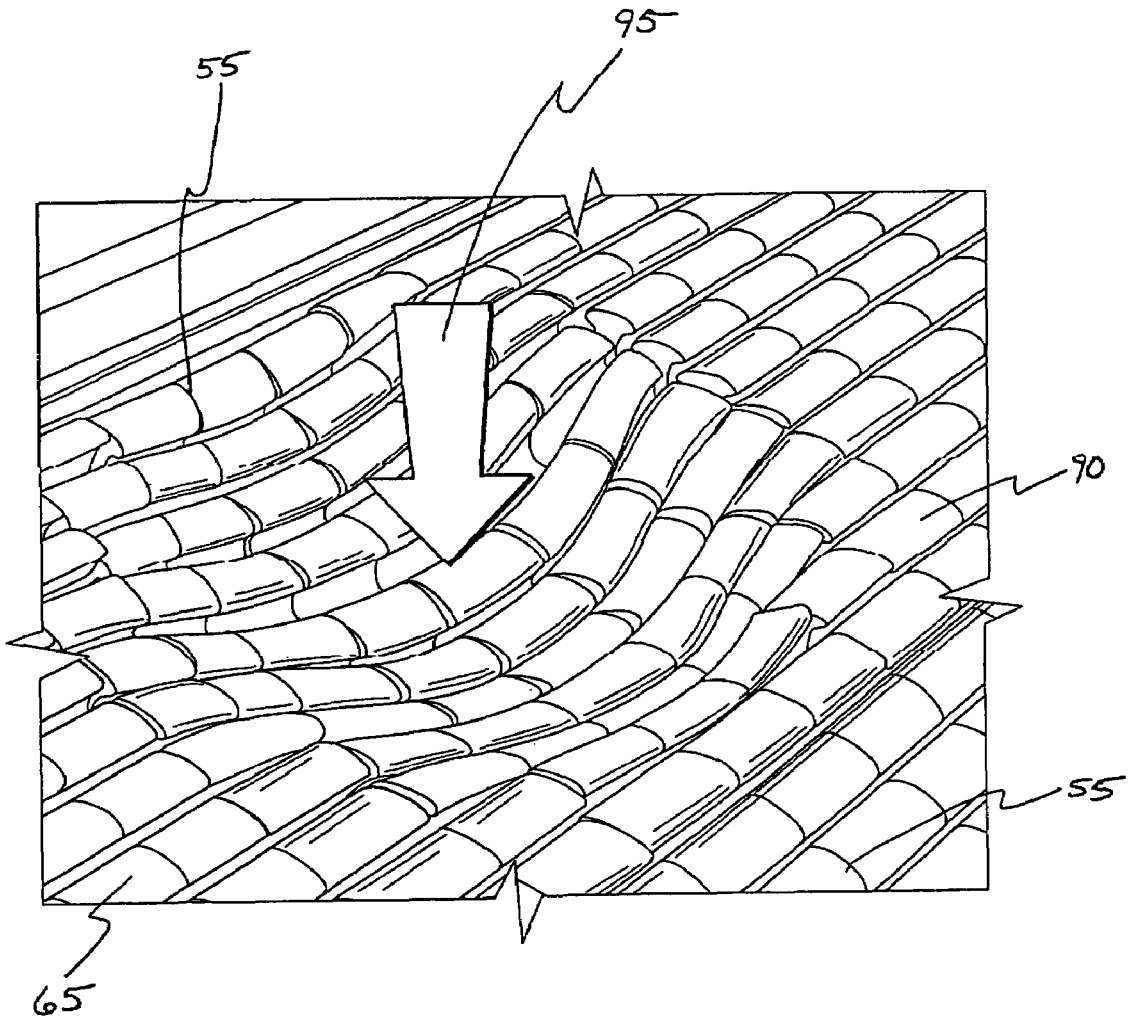
FIG. 7 is an operational illustration of a portion of the support surface of a chair cushion according to the present invention.

The upper surface 30 of the chair cushion 20 may also include longitudinal cuts 55. Such longitudinal cuts 55 may cooperate with the channels 60 to form individual cells 90 upon the upper support surface 30. Such longitudinal cuts 55 may be spaced equally one from another, or may be advantageously differently spaced (not shown), such that the cells 90 would have different widths laterally across the upper support surface 30 so as to provide differing support characteristics to differently-sized cells 90 at different regions about the upper support surface 30. With reference to FIG. 7, it will be understood that provision of such longitudinal cuts 55 to create individual cells 90 allows for more independent pressure dispersion by the cells 90 in response, for example, to gravitational forces such as depicted by force vector 95.

Various modifications and variations can be made in the embodiments of the present invention without departing from the scope and spirit of the invention. It is intended that the present invention include such modifications and variations as come within the scope of this disclosure and their equivalents.

What is claimed is:

1. A chair cushion, comprising:

a main body of resilient material, said main body having a head end and an opposed foot end and defining a length between;

an upper support surface defined by said main body, for receipt of a person thereon;

said upper support surface including a plurality of support zones along said length;

said upper support surface including a plurality of directional support ribs disposed transverse to said length within at least one said support zones;

each said directional support rib defining a cross-sectional geometry, said cross-sectional geometry including a superior aspect and an opposed inferior aspect, said superior aspect longer than said inferior aspect, each said directional support rib defining a directional orientation from said superior aspect toward said inferior aspect;

wherein said support zones include an upper torso support zone disposed for support of the upper torso on a person upon said chair cushion, a gluteal support zone disposed for support of the gluteal region of a person upon said chair cushion, a thigh support zone disposed for support of the thighs of a person upon said chair cushion, and a lower leg support zone disposed for support of the lower legs of a person upon said chair cushion; and wherein said thigh support zone includes a plurality of said directional support ribs having directional orientation toward said head end of said chair cushion, and wherein said upper torso support zone and said gluteal support zone and said lower leg support zone include a plurality of said directional support ribs having a directional orientation toward said foot end of said chair cushion.

2. The chair cushion of claim 1, wherein each said support zone is generally planar.

3. The chair cushion of claim 1, wherein each said support zone is generally planar, each said support zone converging with an adjacent said support zone.

4. The chair cushion of claim 1, further comprising a plurality of cuts formed in said upper support surface along said length.

5. The chair cushion of claim 4, wherein said cuts are spaced equally one from another.

6. The chair cushion of claim 4, wherein said cuts are spaced one from another by predetermined differing distances.

7. A chair cushion, comprising:

a main body of resilient material, said main body having a head end and an opposed foot end and defining a length between;

an upper support surface defined by said main body, for receipt of a person thereon;

said upper support surface including a plurality of support zones along said length, each said support zone generally planar, each said support zone intersecting with an adjacent said support zone;

said upper support surface including a plurality of directional support ribs disposed transverse to said length within at least one said support zones;

each said directional support rib defining a curvilinear cross-sectional geometry including a centerline disposed at an acute angle to said at least one said support zone, said acute angle defining a directional orientation of each said directional support rib;

wherein said support zones include an upper torso support zone disposed for support of the upper torso on a person upon said chair cushion, a gluteal support zone disposed for support of the gluteal region of a person upon said chair cushion, a thigh support zone disposed for support of the thighs of a person upon said chair cushion, and a lower leg support zone disposed for support of the lower legs of a person upon said chair cushion; and wherein said thigh support zone includes a plurality of said directional support ribs having directional orientation toward said head end of said chair cushion, and wherein said upper torso support zone and said gluteal support zone and said lower leg support zone include a plurality of said directional support ribs having a directional orientation toward said foot end of said chair cushion.

8. The chair cushion of claim 7, further comprising a plurality of cuts formed in said upper support surface along said length.

9. The chair cushion of claim 8, wherein said cuts are spaced equally one from another.

10. The chair cushion of claim 8, wherein said cuts are spaced one from another by predetermined differing distances.

* * * * *